US005125803A

United States Patent [19]

Terauchi

[11] Patent Number: 5,125,803

[45] Date of Patent: Jun. 30, 1992

[54] WOBBLE PLATE TYPE COMPRESSOR WITH VARIABLE DISPLACEMENT MECHANISM

[75] Inventor: Kiyoshi Terauchi, Isesaki, Japan

[73] Assignee: Sanden Corporation, Gunma, Japan

[21] Appl. No.: 700,254

[22] Filed: May 15, 1991

[30] Foreign Application Priority Data

May 16, 1990 [JP] Japan ..... 2-124255

[51] Int. Cl.[5] ..... F01B 3/00; F01B 13/04

[52] U.S. Cl. ..... 417/269; 92/12.2

[58] Field of Search ..... 417/269, 222 R, 222 S; 92/12.2

[56] References Cited

U.S. PATENT DOCUMENTS 2,299,235 10/1942 Snader .
2,400,119 5/1946 Joy .
2,682,226 6/1954 Brennan .
3,093,081 6/1963 Budzich ..... 417/222 R
4,061,443 12/1977 Black .
4,073,603 2/1978 Abendschein et al. ..... 417/222 S
4,174,191 11/1979 Roberts ..... 417/222
4,231,713 11/1980 Widdowson .
4,294,139 10/1981 Bex .
4,433,596 2/1984 Scalzo .
4,506,648 3/1985 Roberts .
4,543,043 9/1985 Roberts .
4,553,905 11/1985 Swain et al. ..... 417/222 S
4,846,049 7/1989 Terauchi ..... 92/12.2
4,878,817 11/1989 Kikuchi .
4,880,360 11/1989 Terauchi .

*Primary Examiner*—Leonard E. Smith
*Attorney, Agent, or Firm*—Banner, Birch, McKie & Beckett

[57] ABSTRACT

A wobble plate type compressor with a variable displacement mechanism is described. A cylindrical member having a central hole and which supports the wobble plate at a variable angle of inclination is also described. The central hole has an annular edge portion on an inner surface which contacts the outer peripheral surface of the drive shaft to restrict radial movement of the cylindrical member while permitting the angle of inclination of the cylindrical member to be varied. The annular edge portion is a circular surface defined by the intersection of a first inclined surface of a first right circular cone that has an apex and a center point on the base and a second inclined surface of a second right circular cone that has an apex and a center point on the base. A central axis passes through the center point of the annular edge portion circle and the apex and center point of the base of both right circular cones. The first right circular cone opens toward one end of the cylindrical member and the second right circular cone opens toward the other end of the cylindrical member. Thus, the shape of the central hole is very simply and easily formed while the accuracy of the central hole is maintained.

9 Claims, 2 Drawing Sheets

WOBBLE PLATE TYPE COMPRESSOR WITH VARIABLE DISPLACEMENT MECHANISM

BACKGROUND OF THE INVENTION

1. Technical Field

The present invention relates to a wobble plate type compressor with a variable displacement mechanism, and more particularly to a cylindrical member which is formed with a central hole and which supports the wobble plate at a variable inclination angle.

2. Description Of The Prior Art

A wobble plate type compressor which reciprocates a plurality of pistons by converting the rotational movement of a cam rotor into nutational movement of a wobble plate is well known in the art. Changing the inclined angle of the wobble plate changes the stroke length of the pistons and therefore changes the displacement volume of the cylinder. In U.S. Pat. No. 4,846,049, herein incorporated by reference in its entirety, a wobble plate is proximately disposed on a variable angle rotating cylindrical member. The cylindrical member is hingedly connected to a rotor which is fixed on the drive shaft. A central hole is formed through the cylindrical member so that a drive shaft can extend through the central hole. The rotor permits the inclined angle of the cylindrical member to be varied. The inclination angle of the cylindrical member depends upon the pressure difference between the crank chamber and the suction chamber.

In this structure, the inclined angle of the cylindrical member must be easily variable in response to changes in the pressure difference between the crank and suction chambers. Thus, the shape of the central hole is elongated. However, it is difficult to accurately machine the elongated shape.

A working tool is used to form the central hole. Since the shape of the central hole is elongated, the inclined angle of the rotational axis of the working tool must be continuously and smoothly changed within a range of angles to form the shape of the elongated hole. The working tool must not move in a stepwise fashion. However, since the working tool must form the shape of the hole while moving its rotational central axis, it is necessary to provide a complicated control for the movement of the rotational central axis of the work tool to obtain the desired accuracy of the shape of the central hole. Thus, the manufacturing costs for forming the complicated shape of the central hole are very high.

SUMMARY OF THE INVENTION

A wobble plate type compressor with a variable displacement mechanism according to the present invention includes a compressor housing having a crank chamber. A cylinder block is disposed in the compressor housing. A plurality of cylinders are disposed within the cylinder block. A plurality of pistons are reciprocatingly disposed in a respective one of the cylinders. A rotatable drive shaft is rotatably supported and axially fixed in the compressor housing. A rotor is fixed on the drive shaft. A cylindrical member is hingedly connected to the rotor. A central hole is formed through the cylindrical member for receiving the drive shaft. Thus, the angle of the cylindrical member relative to the drive shaft axis can be varied.

The central hole has an annular edge portion on its inner surface which contacts the outer peripheral surface of the drive shaft to restrict radial movement of the cylindrical member while permitting the angle of inclination of the cylindrical member to be varied. The annular edge portion is defined by the intersection of a first inner surface extending inwardly from one axial end surface of the cylindrical member and a second inner surface extending inwardly from the other axial end surface of the cylindrical member. The annular edge portion is the circle defined by the intersection of the inner surfaces.

The first inner surface defines a portion of a first right circular cone with an apex and a central point at its base. A central axis passes through the apex and central point of the base and also through the central point of the circle defined by the annular edge portion. The first right circular cone opens toward one axial end of the cylindrical member. The second inner surface defines a portion of a second right circular cone which has an apex and a central base point which are on the central axis. The second right circular cone opens toward the other axial end of the cylindrical member. The central axis as well as both right circular cones are inclined relative to a perpendicular axis passing through the central hole of the cylindrical member. A wobble plate is disposed on the cylindrical member and is coupled to the pistons.

The present invention provides the advantage that a wobble plate type compressor including a cylindrical member with a central hole for supporting the wobble plate can be easily and inexpensively manufactured.

Various additional advantages and features of novelty which characterize the invention are further pointed out in the claims that follow. However, for a better understanding of the invention and its advantages, reference should be made to the accompanying drawings and descriptive matter which illustrate and describe preferred embodiment of the invention.

DETAILED DESCRIPTION OF THE PREFERRED EMBODIMENT

Figure 1:
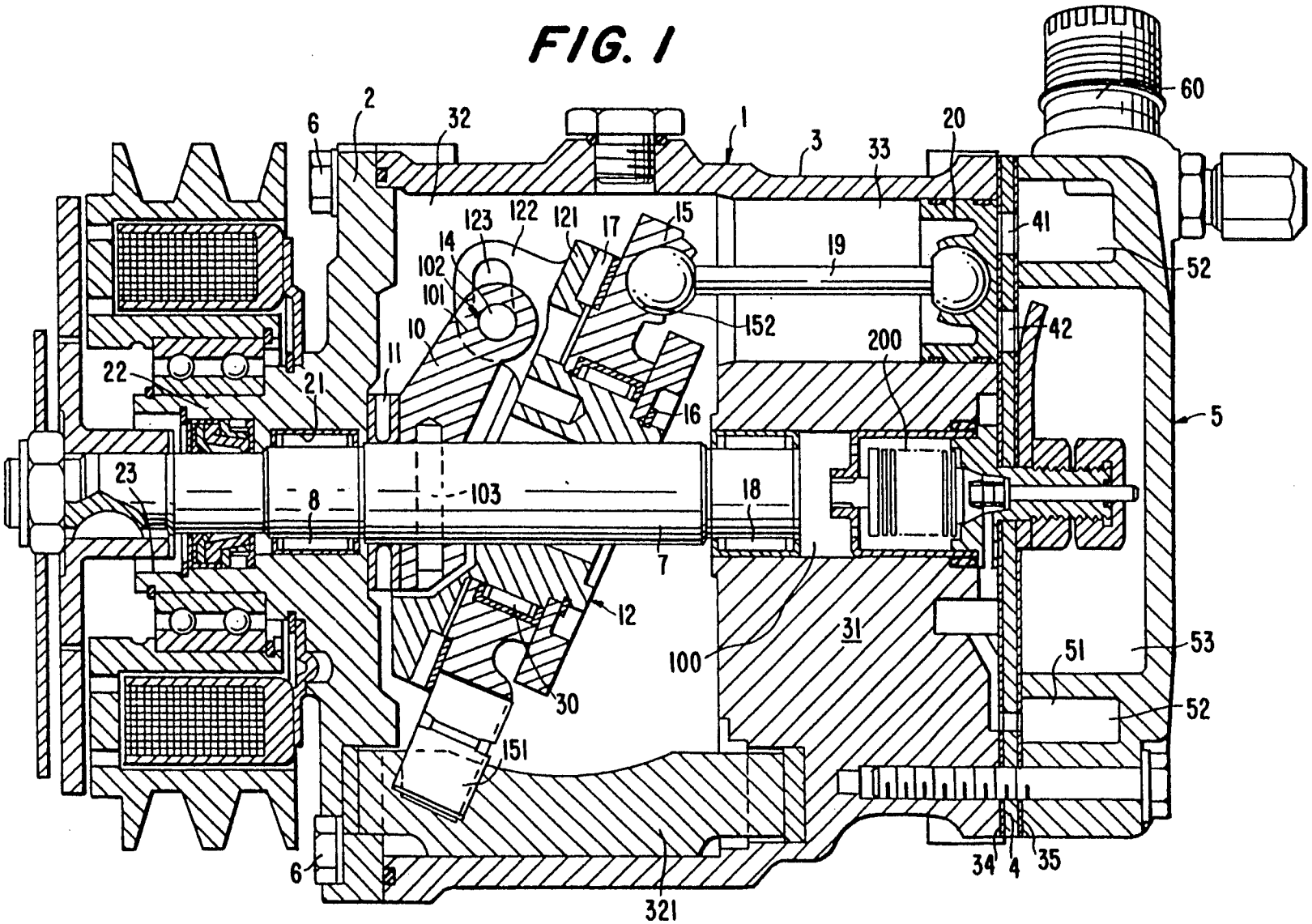
FIG. 1 is a cross-sectional view of a wobble plate type compressor with a variable displacement mechanism in accordance with this invention.

Referring to FIG. 1, wobble plate type compressor 1 includes front end plate 2, cylinder casing 3 having cylinder block 31, valve plate 4 and cylinder head 5. End plate 2 is fixed on one end of cylinder casing 3 by securing bolts 6. Cylinder casing 3 is provided with cylinder block 31 spaced from end plate 2 such as to define crank chamber 32. Cylinder block 31 has a plurality of equiangularly spaced cylinders 33 formed therein. Axial hole 21 is formed through the center of end plate 2 and receives drive shaft 7. Radial bearing 8 is disposed in axial hole 21 and rotatably supports drive shaft 7. Annular sleeve portion 22 projects from end plate 2 and surrounds drive shaft 7, defining seal cavity 23. The other end of drive shaft 7 is rotatably supported through radial bearing 18 in the central bore of cylinder block 31.

Cam rotor 10 is fixed on drive shaft 7 by pin 103. Thrust needle bearing 11 is disposed between the inner wall surface of end plate 2 and the adjacent axial end surface of cam rotor 10. First arm portion 101 extends from cam rotor 10 in the direction of cylinder block 31. First arm portion 101 includes hole 102. Cylindrical member 12 is formed with flange portion 121 and is disposed around drive shaft 7. Two second arm portions 122 are formed on the outer surface of flange portion 121 of cylindrical member 12 and extend toward first arm portion 101 of cam rotor 10. A single elongated hole 123 is formed in each second arm portion 122. Hole 102, formed in first arm portion 101, is aligned with elongated holes 123. Pin 14 is inserted into hole 102 and extends outwardly therefrom such that it is slidably movable within elongated holes 123.

Ring-shaped wobble plate 15 is rotatably mounted on the outer cylindrical surface of cylindrical member 12 through radial needle bearing 30. Axial movement of wobble plate 15 is prevented by flange portion 121 and snap ring 16 disposed on cylindrical member 12. Thrust needle bearing 17 is disposed in a gap between flange portion 121 and wobble plate 15. Sliding member 151 is attached on the outer peripheral portion of wobble plate 15 and projects toward the bottom surface of cylinder casing 3. The end of sliding shaft 151 is slidably disposed on the outer surface of guide bar 321 to prevent the rotation of wobble plate 15. The angle of inclination of the cylindrical member varies in dependence upon the difference between the crank and suction chamber pressures to vary the compression volume. As the inclination angle of the cylindrical member varies, pin 14 slides within holes 123 in second arm portions 122. The provision of second arm portions 122 and pin 14 prevents cylindrical member 12 from becoming inclined perpendicularly to the axis of drive shaft 7.

A plurality of pistons 20 are disposed one in each respective cylinder 33 of cylinder block 31. Piston rods 19 (only one being shown) link pistons 20 to wobble plate 15. One end of piston rod 19 is rotatably connected to receiving surface 152 of wobble plate 15. The other end of each piston rod 19 is rotatably connected to one piston 20 which is slidably disposed in cylinder 33.

Suction ports 41 and discharge ports 42 are formed in valve plate 4. A suction reed valve (not shown) is disposed on one side of valve plate 4. A discharge reed valve (not shown) is disposed on the opposite side of valve plate 4. Cylinder head 5 is connected to cylinder casing 3 through gaskets 34 and 35, with valve plate 4 sandwiched between the gaskets. Partition wall 51 extends axially from the inner surface of cylinder head 5 and divides the interior of cylinder head 5 into suction chamber 52 and discharge chamber 53. Suction chamber 52 is connected to the external fluid circuit through fluid inlet port 60 formed in cylinder head 5. Discharge chamber 53 is connected to the external fluid circuit through a fluid outlet port (not shown) also formed in cylinder head 5.

Crank chamber 32 of cylinder casing 3 and suction chamber 52 of cylinder head 5 are connected through passageway 100. Variable displacement device 200 is disposed in passageway 100 to control the link of the crank and suction chambers and thus control the pressure difference therebetween to thereby control the angle of cylindrical member 12 and wobble plate 15. The structure of the passageway, the variable displacement device and the control method for varying the inclined angle of cylindrical member 12 and wobble plate 15 are shown as an example and are disclosed in U.S. Pat. No. 4,960,367 herein incorporated by reference in its entirety.

Figure 2:
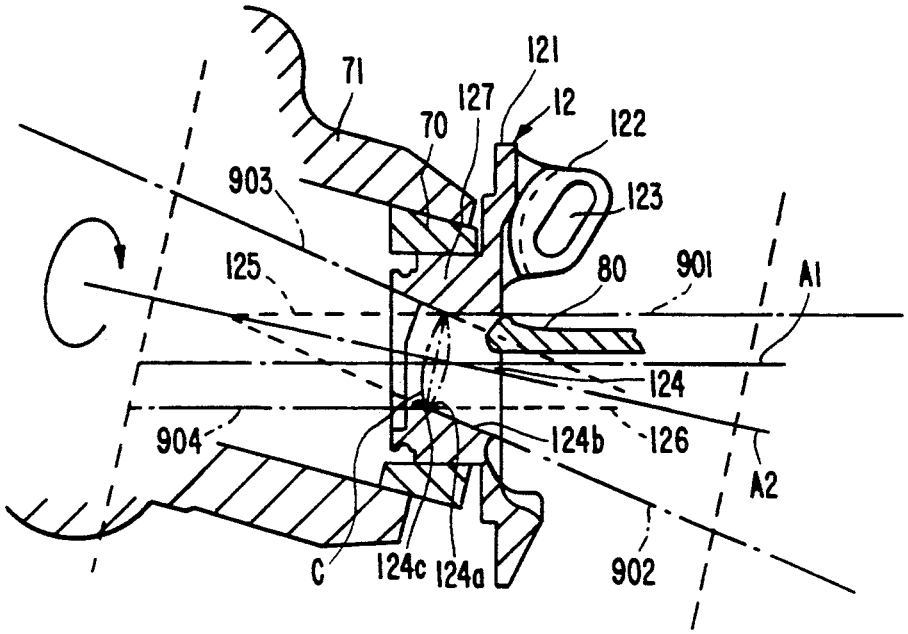
FIG. 2 is an illustrative view of a cylindrical member used in a wobble plate type compressor with a variable displacement mechanism as shown in FIG. 1 and the method of manufacture thereof.
Figure 3:
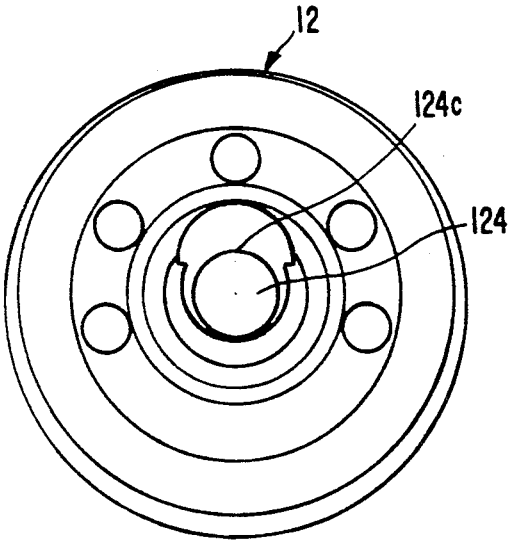
FIG. 3 is a front view of a cylindrical member as shown in FIG. 2.
Figure 4:
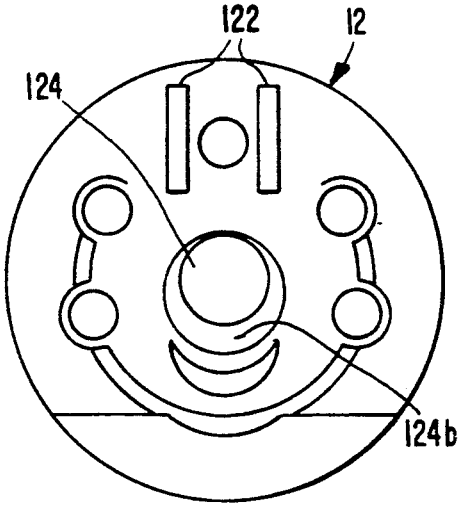
FIG. 4 is a rear view of a cylindrical member as shown in FIG. 2.

Referring to FIGS. 2–4, the construction of a cylindrical member formed in accordance with the present invention is shown. Central hole 124 is formed through cylindrical member 12 with an annular edge portion **124*a*. Annular edge protion 124*a* is a circular surface defined by the intersection of first inner surface 124*b* extending inwardly from one axial end of cylindrical member 12 and second inner surface 124*c* extending inwardly from the other axial end of cylindrical member 12. First central axis A1 is perpendicular to the axial end surfaces of flange portion 121 and passes through the central point of circle C defined by annular edge portion 124*a*. Second central axis A2 also passes through the central point of circle C and is inclined about 14 degrees from first central axis A1**.

First inner surface **124*b* is a portion of right circular cone 125 defined by extending lines 901 and 902 which pass through the apex of the cone and correspond to the upper and lowermost locations of surface 124*b*. The apex and the central point of the base of first right circular cone 125 lie on second central axis A2. Thus, the cone is inclined relative to first central axis A1. First right circular cone 125 opens toward a first end of cylindrical member 12. Similarly, second inner surface portion 124*c* is a portion of right circular cone 126 defined by extending lines 903 and 904 which pass through the apex of the cone and correspond to the upper and lowermost locations. The apex and the central point of the base of second right circular cone 126 also lie on second central axis A2. Second right circular cone 126 opens toward a second end of cylindrical member 12 opposite the first end. Thus, both cones are inclined relative to central axis A1. In this specific embodiment, the included angle of the apex of respective first and second right circular cones 125 and 126 is about 39.8 degrees. The value of angle of the apex may be changed in accordance with the design of cylindrical member 12. Right circular cones 125, 126** need not be equivalent cones, the conical shape of each cone can be varied with the design of the cylindrical member.

Formation of central hole 124 of cylindrical member 12 is accomplished as follows. First, a hole having a uniform circular cross-section is precut or formed in cylindrical member 12. Next, cylindrical member 12 is retained at its boss portion 127 by chuck 71 through jig 70. Chuck 71 is rotated about central axis A2 while work tool 80 is moved axially along one of extending lines 901 and 902 to thus form first inner surface **124*b*. After first inner surface 124*b* of central hole 124 is formed, the angle of inclination of work tool 80 is changed to extend along one of extending lines 903 and 904. Work tool 80 is thereafter moved axially to form second inner surface 124*c*. It is not necessary to change the central axis of the work tool when only one of the inner surface 124*b* or 124*c* is being formed. Thus, central hole 124 of cylindrical member 12** can be easily formed by a much simpler work tool according to the present invention.

Since cylindrical member 12 is rotated about an axis which is at an angle to the central axis A1, of the precut hole, surfaces **124*b* and 124*c* can be formed as conical surface portions having a central axis inclined relative to the central axis of the cylindrical member by simply moving the work tool along a straight line segment. Thus, the angle of the work tool need not be changed while it is moving axially as in the prior art. In addition, the axial location of edge portion 124***a* which is designed to contact the drive shaft of the compressor, as well as the degree to which the inclination angle of the cylindrical member with respect to the drive shaft may be varied, can be selected simply by adjusting the axial extent to which the work tool is moved to form the first conical surface portion, and by choosing the angle of the axis of rotation of the chuck with respect to the central axis, respectively. These selections would be made as a matter of design choice in dependence on the requirements of the device with which the cylindrical member is to be used.

This invention has been described in detail in connection with the preferred embodiment. This embodiment, however, is merely for example only and the invention is not restricted thereto. It will be understood by those skilled in the art that other variations and modifications can easily be made within the scope of this invention as defined by the claims.

I claim:

1. A cylindrical element for supporting a wobble plate in a wobble plate type compressor, said cylindrical element have two ends and a central through hole passing through both ends to define an interior surface, the interior surface of said through hole having an annular edge portion spaced inwardly from both ends along a first central axis, the interior surface formed on one side of said annular edge portion is defined by a portion of a right circular conical surface having an apex and a center point on the base which defines a second central axis that is inclined at an angle, greater than zero, relative to said first central axis.

2. The cylindrical element recited in claim 1, the interior surface formed on the other side of said annular edge portion is also defined by a portion of a right circular conical surface also having an apex and a center point on the base which lie on said second central axis, with said annular edge portion being defined by the intersection of said conical surface portions.

3. A whole plate compressor comprising:

a compressor housing having a plurality of cylinders disposed therein;

a plurality of pistons, each of said pistons being reciprocatingly disposed in a respective one of said cylinders;

a rotatable drive shaft rotatably supported by and axially fixed within said compressor housing;

a rotor fixedly attached to said drive shaft;

a cylindrical member hingedly connected to said rotor and inclined with respect to said drive shaft, said hinged connection allowing the angle of inclination of said cylindrical member with respect to said drive shaft to be varied;

a central hole formed through said cylindrical member for receiving said drive shaft, said central hole having an annular edge portion on an inner surface which contacts the outer peripheral surface of said drive shaft to restrict radial movement of said cylindrical member while permitting the angle of inclination of said cylindrical member to be varied, a first central axis being defined by a circular surface created by said annular edge portion, with said annular edge portion being defined by the intersection of a first inner surface extending inwardly from one axial end of said cylindrical member and a second inner surface extending inwardly from the other axial end of said cylindrical member, said first inner surface defined as a portion of a first right circular cone having an apex and a center point on the base of said first right circular cone which lie on a second central axis that is inclined at an angle, greater than zero, relative to said first central axis, said first right circular cone opening toward said one end, said second inner surface defined as a portion of a second right circular cone having an apex and center point on the base of said second right circular cone which lie on said second central axis, said second right circular cone opening toward said other axial end; and a wobble plate disposed about said cylindrical member and coupled to said pistons.

4. The wobble plate type compressor of claim 3 wherein said cylindrical member includes two arm portions and said rotor includes one arm portion, a pin disposed through holes in said arms portion to form the hinged connection.

5. The wobble plate type compressor of claim 3 wherein said first and second central axes intersect at a point located within said central hole.

6. The wobble plate type compressor of claim 3 wherein said second central axis is inclined relative to said first central axis at approximately an angle of 14°.

7. The wobble plate type compressor of claim 3 wherein the apex angle of said first and second right circular cones is approximately 39.8°.

8. The wobble plate type compressor of claim 3 wherein said drive shaft also includes an axis which can align with said second central axis when said cylindrical member is inclined at a predetermined angle.

9. The wobble plate type compressor of claim 8 wherein said cylindrical member includes two arm portions and said rotor includes one arm portion, a pin disposed through holes in said arms to form the hinged connection.

* * * * *